US006899222B2

(12) United States Patent
Jones et al.

(10) Patent No.: US 6,899,222 B2
(45) Date of Patent: May 31, 2005

(54) GAME CONTROLLER PACKAGING WITH LIMITED CONSUMER ACCESS

(75) Inventors: Andrew B. Jones, McKinney, TX (US); Christopher A. Wilson, Plano, TX (US); Colin M. Ferris, Dallas, TX (US)

(73) Assignee: Radica Games Ltd., Hamilton (BM)

( * ) Notice: Subject to any disclaimer, the term of this patent is extended or adjusted under 35 U.S.C. 154(b) by 6 days.

(21) Appl. No.: 10/695,942

(22) Filed: Oct. 30, 2003

(65) Prior Publication Data

US 2005/0092626 A1 May 5, 2005

(51) Int. Cl.[7] ..... B65D 75/00; B65D 85/38

(52) U.S. Cl. ..... 206/305; 206/320; 206/471; 273/148 B

(58) Field of Search ..... 206/305, 320, 206/461–465, 467–471; 273/148 B

(56) References Cited

U.S. PATENT DOCUMENTS

| | | | | |
|---|---|---|---|---|
| 4,573,682 | A * | 3/1986 | Mayon | 273/148 B |
| 4,702,374 | A | 10/1987 | Kelner | |
| 4,872,551 | A * | 10/1989 | Theros | 206/349 |
| 5,046,739 | A * | 9/1991 | Reichow | 273/148 B |
| 5,188,222 | A | 2/1993 | Pierce | |
| 5,279,417 | A | 1/1994 | Seaton | |
| 5,289,916 | A | 3/1994 | Mickelberg | |
| 5,435,447 | A | 7/1995 | Weatherford | |
| 5,501,458 | A | 3/1996 | Mallory | |
| 5,622,258 | A | 4/1997 | Baublitz et al. | |
| 5,871,099 | A | 2/1999 | Mellenthin et al. | |
| 6,011,489 | A | 1/2000 | Ki Kwan et al. | |
| 6,126,008 | A | 10/2000 | Cox | |
| 6,216,866 | B1 | 4/2001 | Schoenberg | |
| 6,241,247 | B1 | 6/2001 | Sternberg et al. | |
| 6,311,839 | B1 | 11/2001 | Lo | |
| 6,401,932 | B1 | 6/2002 | Weinstein et al. | |
| 6,467,617 | B1 | 10/2002 | Chen | |
| 6,530,570 | B2 * | 3/2003 | Ku | 273/148 B |
| 6,612,432 | B2 * | 9/2003 | Motson | 206/305 |
| 2002/0162771 | A1 | 11/2002 | Wagenen et al. | |
| 2003/0234194 | A1 * | 12/2003 | Clark et al. | 206/320 |

* cited by examiner

*Primary Examiner*—Jim Foster
(74) *Attorney, Agent, or Firm*—Bell, Boyd & Lloyd LLC

(57) ABSTRACT

The present invention relates to packaging for a game console controller, wherein the game console controller has at least one button and at least one directional control device. The packaging includes a first section, and a second section coupled to the first section. Whereby the game console controller is positioned between at least a portion of the first section and the second section, so that the at least one button is accessible and the at least one directional control device is covered by at least one of the first and second sections.

11 Claims, 6 Drawing Sheets

GAME CONTROLLER PACKAGING WITH LIMITED CONSUMER ACCESS

FIELD OF THE INVENTION

The present invention relates generally to the art of packaging for game console controllers. More particularly, the invention relates to a novel packaging arrangement by which portions of a game console controller can be tested by a consumer prior to purchase, while at the same time the packaging protects more delicate portions of the controller, such as a directional stick.

BACKGROUND OF THE INVENTION

Several techniques are used by retail facilities to display products for sale to consumers. For example, products can be stored in paper boxes, which can be opened to allow access to the product inside. One advantage of this technique is that the consumer will have the opportunity to operate and/or try the feel of the product prior to purchase. Due to shoplifting concerns, however, many retail stores will only locate boxed products behind a sales counter. As a result, the consumer may not be able to operate the products except in the presence of a salesperson. In addition, boxed products are generally not suitable for hanging, or so-called "peg board," display.

Alternatively, products may be packaged in a "blister pack," i.e., a sealed package made of transparent and semi-rigid plastic material. Typically, a blister pack will include a hanging aperture for pegboard display. In addition, the transparent nature of the blister pack permits the product to be visually inspected by a consumer. Because the blister pack is closed, however, the user cannot operate or feel the product prior to purchase.

Other packaging systems for products have developed a "try me" feature. For example, U.S. Pat. No. 6,467,617 to Chen discloses a packaging arrangement for fishing reel that permits the reel to be tested by a consumer on a limited basis, while the reel remains in the package.

Additionally, published U.S. patent application Ser. No. 09/850,502 discloses a display package that allows the product to be touched while it remains secure in the package.

Accordingly, a continuing need exists for a improved packaging system that allows the testing of specific portions a game controller while allow the remaining portions of the game controller to be safely enclosed in the packaging system.

SUMMARY OF THE INVENTION

An object of the present invention is to provide a packaging system for a game controller for a video game console.

Another object of the present invention is to provide a packaging system for a game controller for a video game console that allows a consumer to test and/or feel a portion of the game controller.

Yet another object of the present invention is to provide a packaging system for a game controller for a video game console that allows a consumer to test a portion of the game controller, while at the same time protecting delicate portions of the game controller.

The foregoing objects are basically obtained by providing packaging for a game console controller, the game console controller including at least one button and at least one directional control device. The packaging includes a first section, and a second section coupled to the first section.

Whereby the controller for a game console is positioned between at least a portion of the first section and the second section, so that the at least one button is accessible and the at least one directional control device is covered by at least one of the first and second sections.

The foregoing objects are also obtained by providing packaging for a game controller, the game controller including a main portion, a first handle and a second handle, the first handle having at least one control button thereon and the second handle having at least one directional control device thereon. The packaging includes a front portion, and a back portion coupled to the front portion, such that the front and back portions enclose the second handle and a portion of the main portion. An opening is formed between the front and the back portions, the opening being adapted to allow substantially the entire first handle to extend therethrough and thereby expose the at least one control button.

Other objects, advantages, and salient features of the present invention will become apparent to those skilled in the art from the following detailed description, which, taken in conjunction with the annexed drawings, discloses preferred embodiments of the invention.

BRIEF DESCRIPTION OF THE DRAWINGS

Referring to the drawings which form a part of this disclosure.

DETAILED DESCRIPTION OF THE INVENTION

Figure 1:
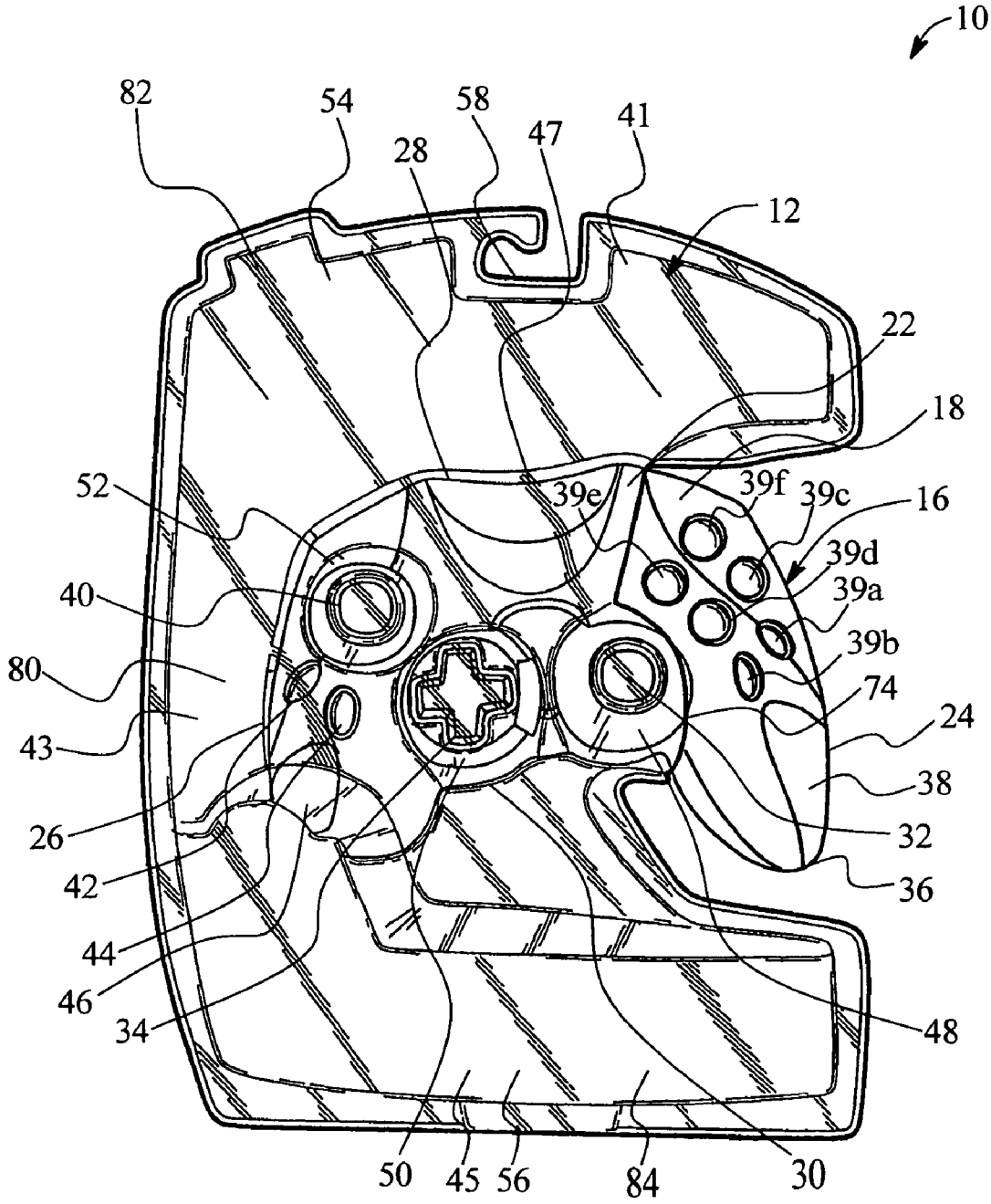
FIG. 1 illustrates a front view of a packaging system according to the present invention.
Figure 2:
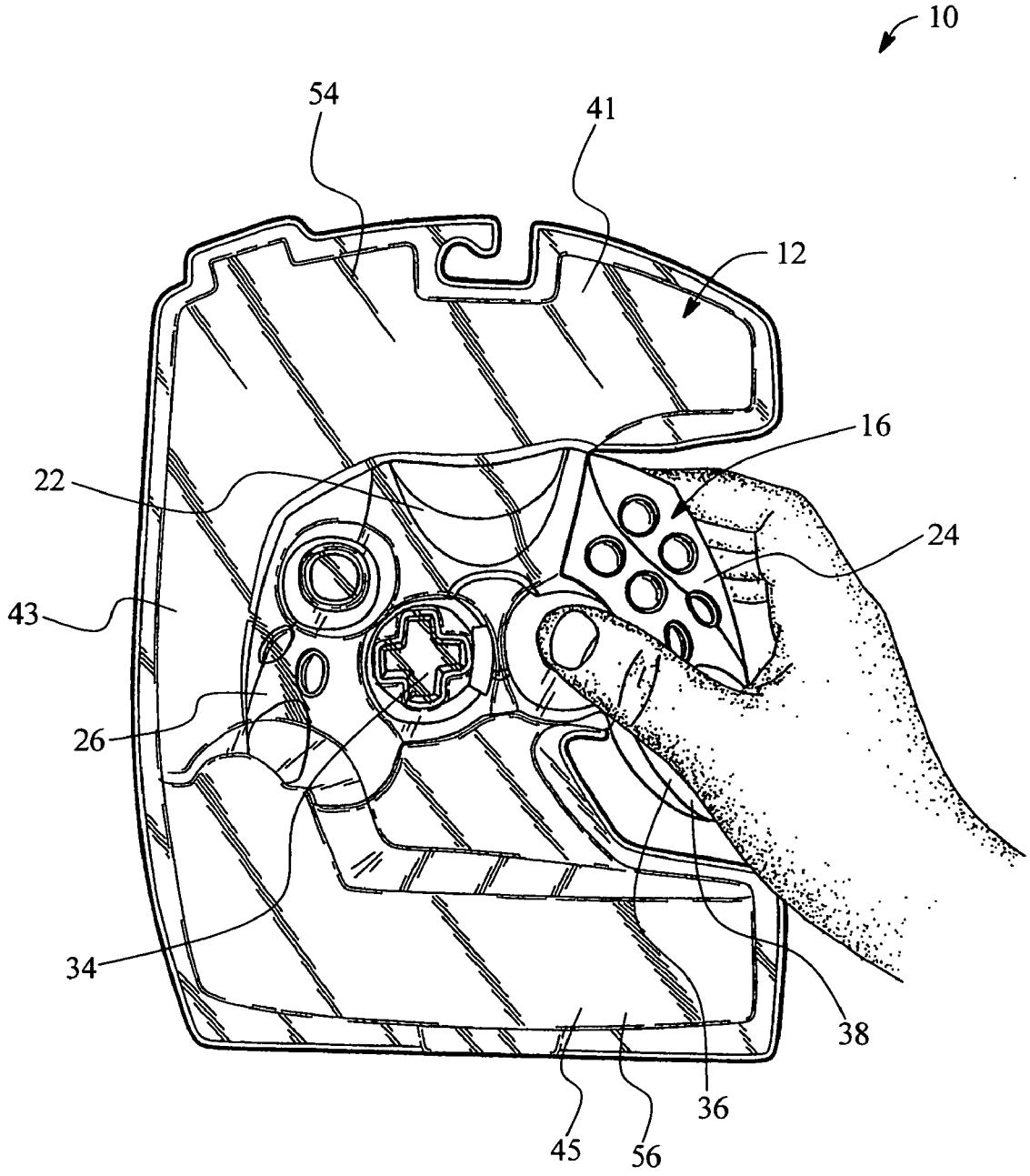
FIG. 2 is a front view of the packaging system of FIG. 1 being tested by a consumer prior to purchase.
Figure 3:
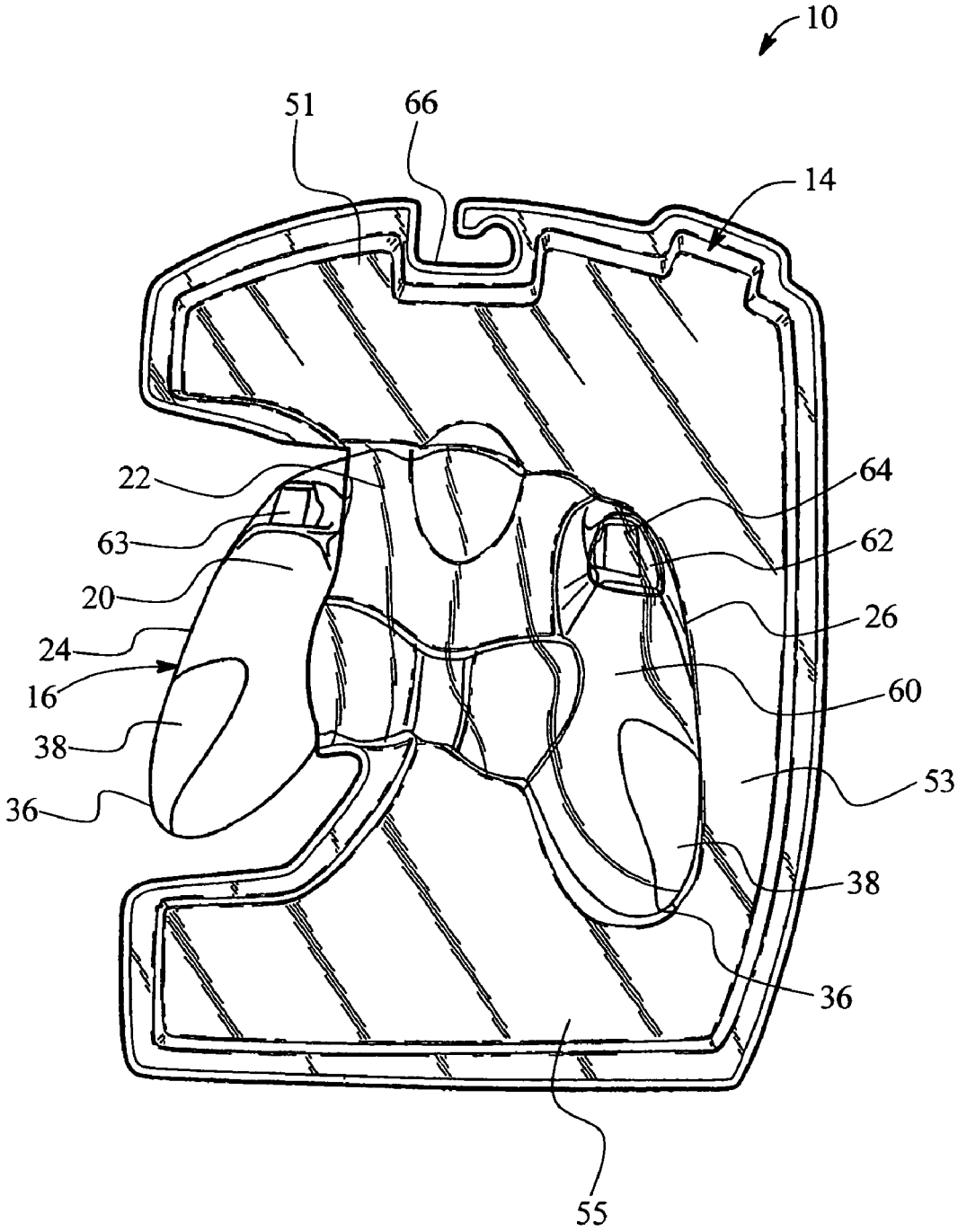
FIG. 3 is rear view of the packaging system shown in FIG. 1.

FIGS. 1–3 illustrate a packaging system 10 that has a front or first section 12 and a back or rear section 14. The front portion 12 and the rear portion 14 are coupled or connected together and are adapted to have a game console controller 16 positioned therebetween.

Controller 16 is preferably formed of plastic and has a front or first side 18 and a back or second side 20. The controller is divided into three portions, a main portion 22, a first handle 24 and a second handle 26, each handle 24 and 26 being connected to main portion 22. Main portion 22 has a top side 28 and a bottom side 30 and also has a directional control stick or "joystick" 32 and a directional control pad 34 positioned thereon each adjacent the bottom side 30. Directional control stick 32 and directional control pad 34 are conventional control devices known in the art; however, the directional control devices can also be any other control devices, such as a roller ball and any other suitable control device.

Figure 5:
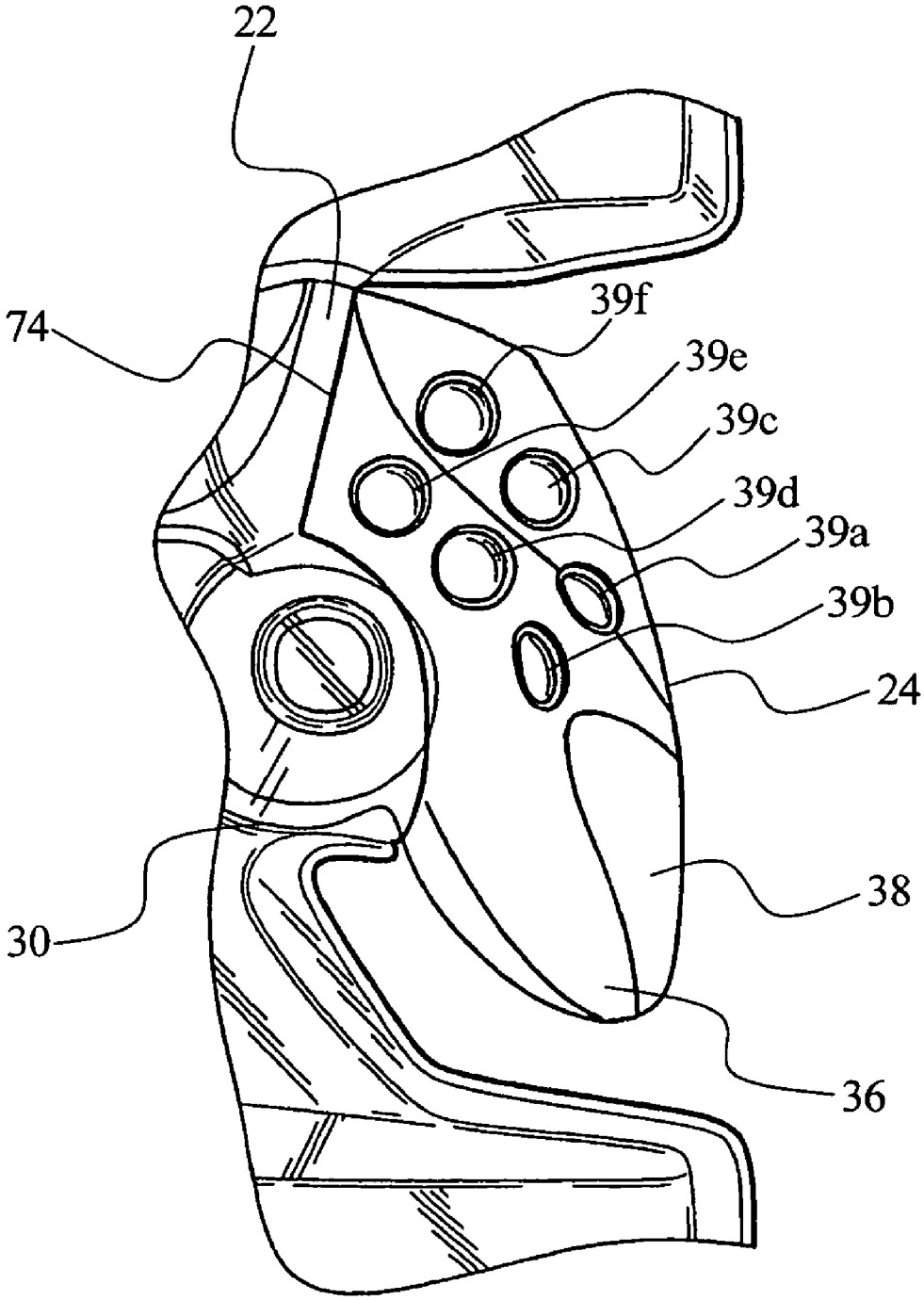
FIG. 5 is an enlarged partial front view of the portion of the packaging system of FIG. 1 that exposes a handle of the game controller.
Figure 6:
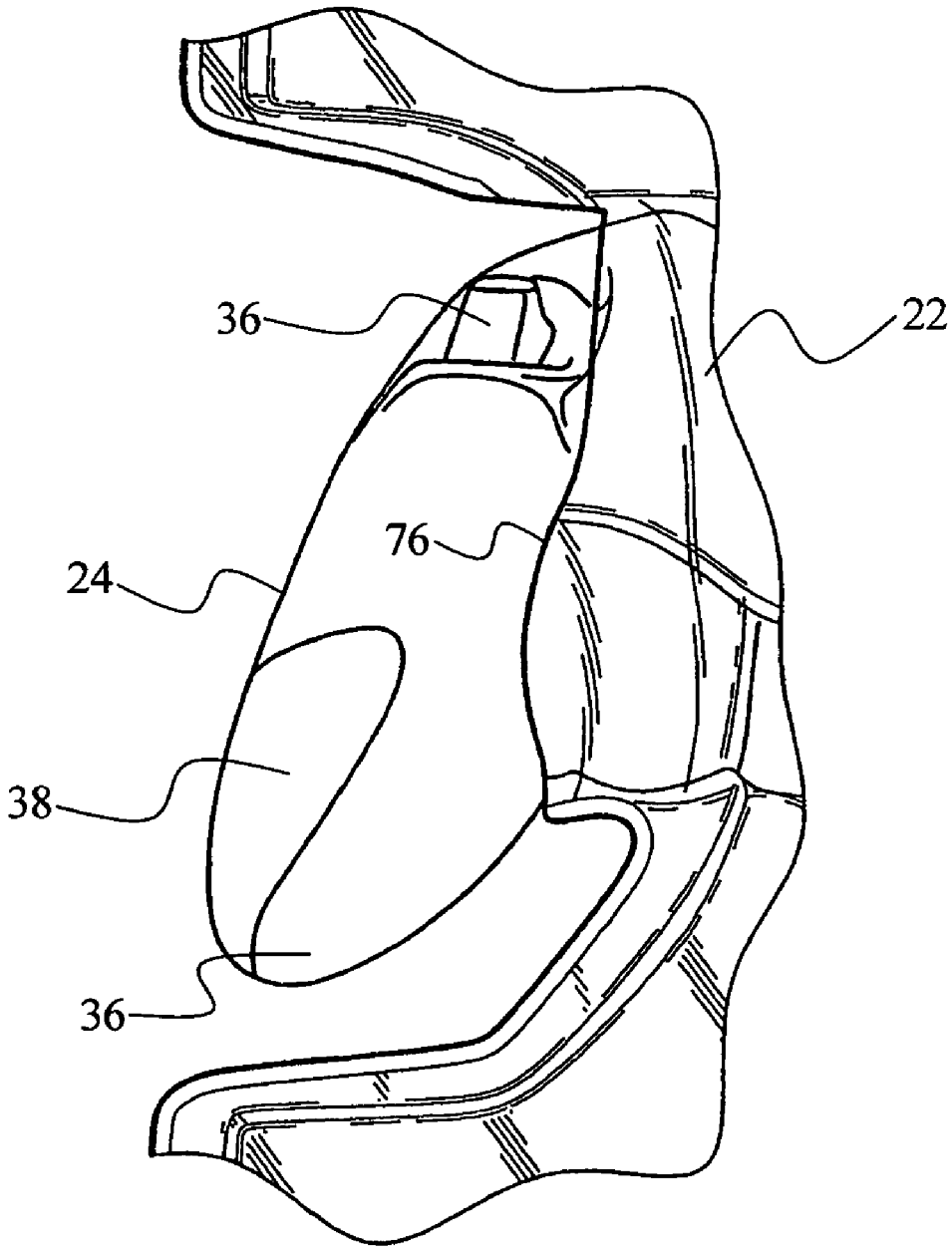
FIG. 6 is an enlarged partial back view of the portion of the packaging system of FIG. 1 that exposes a handle of the game controller.

As shown in FIGS. 5 and 6, first handle 24 is unitary with main portion 22, and has a curved portion 36 that extends beyond the bottom side 30 of the main portion 22. Curved portion 36 is adapted to fit or be gripped by an adult hand, and has a rubber grip or portion 38 for comfort and/or improved feel. The handle 24 is sized and configured to allow an adult hand to comfortably hold the controller with the palm resting on the rubber grip 38 and at least one finger wrapped around curved portion 36. Handle 24 preferably has six control buttons 39*a–f* thereon for performing various functions on specific video games, and a trigger 63 on the underside thereof; however, handle 24 does not necessarily need to have six buttons and a trigger. Handle 24 can have any number of buttons desired or any other controls, such as a directional stick or pad, or no control devices. The size and configuration of the handle 24 allows the user to comfortably grip the handle while using the thumb to manipulate buttons 39*a–f* and using the index finger to manipulate trigger 63.

Second handle 26 is substantially similar to first handle 24; however, handle 24 preferably has a directional control stick 40 and two control buttons 42 and 44 thereon. Directional control stick 40 is a conventional control device known in the art. Handle 26 also has a trigger 64 on the underside thereof.

As with handle 24, handle 26 is sized and configured to allow an adult hand to comfortably hold the controller with the palm resting on the rubber grip 46, the thumb manipulating joystick 32 and the index finger manipulating the trigger 64. Furthermore, handle 26 does not necessarily need to have a directional control stick and two control buttons thereon, and can have any number of buttons desired or any other additional controls, such as another directional stick or a directional control pad, or no control devices at all.

Packaging system 10 is preferably a blister pack formed in the conventional manner using transparent plastic and has two sections or portions, first portion 12 and second portion 14, as disclosed above. However, the packaging system can be formed of any suitable material and does not necessarily need to be transparent. As shown in FIG. 1, first portion 12 covers substantially all of main portion 22 and second handle 26, and leaves substantially all of the first handle 24 exposed.

As shown in FIGS. 1–4, first section 12 is preferably a molded substantially C-shaped piece of transparent plastic. However, it is noted that section 12 can be any shape or material desired. As shown specifically in FIG. 1, first section 12 preferably has a top portion or leg 41, a middle or main portion 43 and a bottom portion or leg 45 that form the substantially C-shape. Top portion 41 and bottom portion 45 preferably extend beyond middle portion 43. However, as noted above, the first section 12 does not necessarily need to be in a C-shaped configuration, as described, and can be any suitable configuration.

The middle section 43 of first section 12 has a molded protrusion or area 47 that is molded to follow the contours of first surface 18 of controller 16, including specific molded protrusions or areas that cover the directional sticks and pads. For example, as shown specifically in FIG. 4, molded area 48 covers directional control stick 32, and molded area 50 covers directional control pad 34. Furthermore, as shown in FIG. 1, molded area 52 covers directional control stick 40. Each of these molded areas protect the precise, sensitive control devices from use during display, while at the same time allows the packaging system to fully display the game controller.

There are additional areas adjacent the main compartment 47, such as area 54 and area 56 in section 41 and section 45, respectively, that can be used for any reason desired, such as storage for accessories, an electrical cord or graphics for a display, as will be discussed in more detail below. Furthermore, first section 12 preferably has a substantially L-shaped cut out area 58 that can be used to hang the packaging system and controller on a display hook (not shown).

Section 14 is preferably a molded substantially C-shaped piece of transparent plastic, and substantially matches the overall shape and size of section 12. For example, section 12 also has a top portion 51, a middle portion 53 and bottom portion 55 that form the substantially C-shape. However, it is noted that section 14 can be any shaped or material desired, as long as section 14 can be coupled to section 12. Middle portion 53 of section 12 has a molded area or protrusion 60 that conforms to the shape of the game controller second surface 20, and a molded area or protrusion 62 that protects and substantially covers trigger 64. The remaining portions of section 14 are substantially flat. Section 14 has a substantially L-shaped cut out area 66 that matches L-shaped cut out area 58, and allows the packaging system and controller to be displayed on a display hook (not shown).

Figure 4:
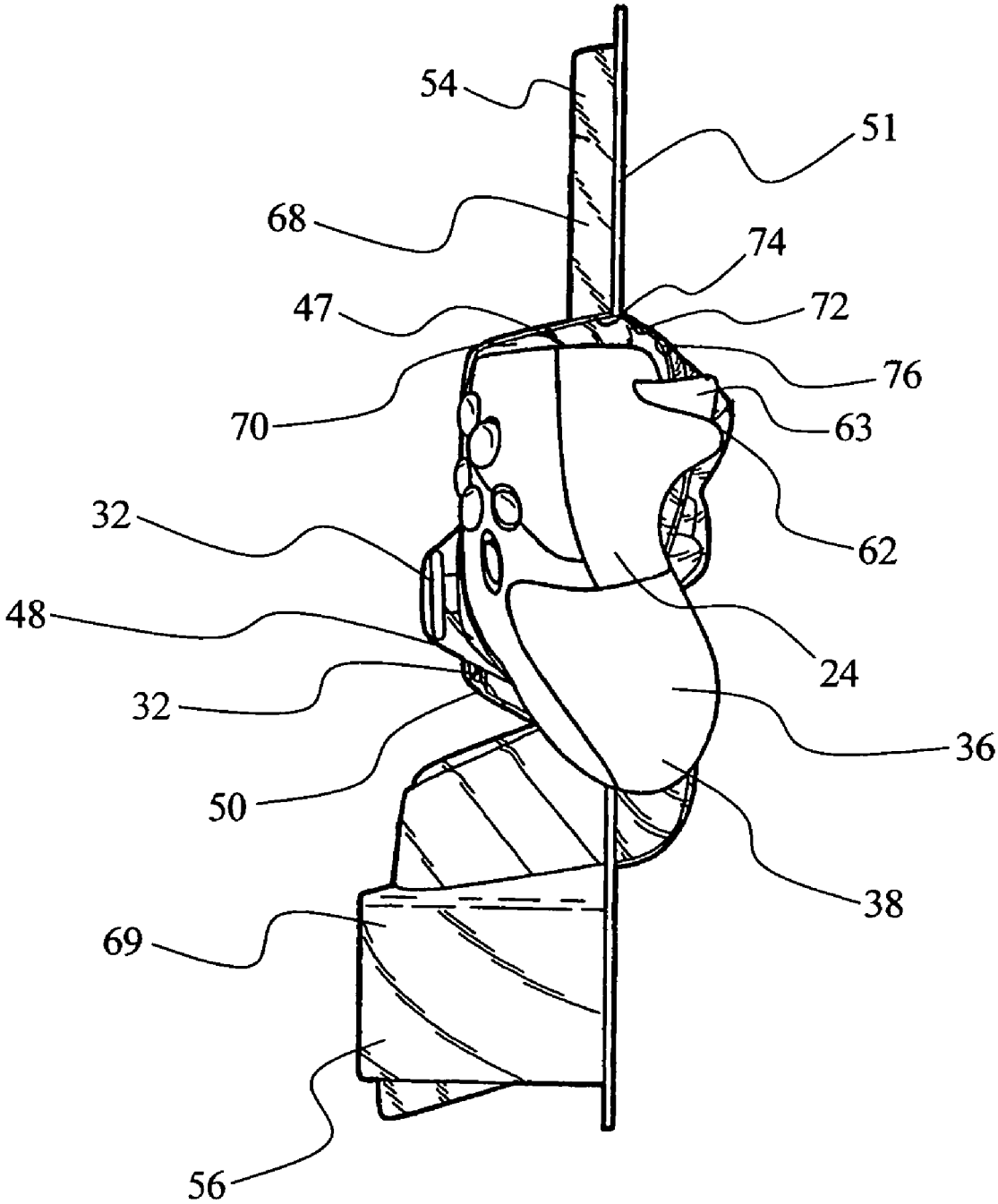
FIG. 4 is a side view of the packaging system shown in FIG. 3.

During packaging, section 12 is coupled to section 14, enclosing at least a portion of controller 16 therein. Section 12 is coupled to section 14 using any conventional method, such as heat sealing, glue, or any other mechanical or chemical means desired, or any other suitable means desired. When sections 12 and 14 are coupled together, the form a main portion 80, an upper leg 82 and a lower leg 84 of the overall C-shape configuration. Generally, as shown in FIG. 4, three cavities are formed, one in the upper leg, one in the lower leg, and one in the main or first portion. The first cavity 68 is formed between the protrusion 54 and the upper leg 82. Cavity 68 is generally sized and configured to receive display graphics or advertisement or any other suitable material.

Second cavity 69 is formed between protrusion 56 in section 12 and bottom portion 55 of section 14 in lower leg 82. Cavity 69 is preferably used to hold the controller cord and suitable graphics; however, as with cavity 68, cavity 69 can have any desired use.

Third cavity 70 is sized and configured to receive portions or a majority of controller 16, and is formed by protrusion 47 in the first section 12 and protrusion 60 in second section 14 in main portion 80. As described above, both protrusions 47 and 60 substantially conform to a respective surface of the controller. As shown in FIG. 4, cavity 70 has an opening formed therein. Opening 70 allows at least first handle 24 to extend therethrough; however, a portion of the main portion 22 can also extend therethrough, if desired. As shown in FIGS. 1 and 4, opening 72 is defined by the edge 74 of the first section and the edge 76 of the second section.

Since majority of the controller 12, including sensitive portions such the direction control sticks and buttons, is protected and covered by the packaging system, the controller will be protected from damage and/or harm during shipping, packing and/or handling by the vender and the consumer. Furthermore, since substantially the entire first handle 24 is exposed or uncovered by the packaging system, a consumer may hold and test the control for comfort and possible playability. For example, as shown in FIG. 2, a consumer can test the handle for specific size and comfort of the curved portion 36 or of the grip portion 38, and the playability and use of the buttons 39*a–f* and finger trigger 63.

Additionally, since the first section of the packaging system has portions 41 and 45 that extend beyond the middle section 43, and the second section has portions 51 and 55 that extend beyond the middle section 53, the exposed first handle is protected from damage. As shown in FIGS. 1 and 3, sections 41 and 45 and section 51 and 55 extend beyond handle 24, and therefore, if the controller and packaging system is dropped or thrown, the controller will not land on the handle, but rather the bulk of any impact will likely be taken by these sections of the packaging system.

While a specific embodiment has been chosen to illustrate the invention, it will be understood by those skilled in the art that various changes and modifications can be made therein without departing from the scope of the invention as defined in the appended claims.

What is claimed is:

1. Packaging in combination with a game console controller, the game console controller including at least one button and at least two directional control devices, the packaging comprising:

a first section; and a second section coupled to said first section;

said game console controller being positioned between at least a portion of said first section and said second section, so that the at least one button is accessible and the at least two directional control devices are covered by at least one of the first and second sections.

2. Packaging according to claim 1, wherein said first and second sections are formed from plastic.

3. Packaging according to claim 2, wherein said first and second sections are transparent.

4. Packaging according to claim 1, wherein the game console controller has a first handle and a second handle; and said second section is coupled to said first section in such a manner that said first and second sections cover the entire second handle, while exposing at least a portion of the first handle.

5. Packaging according to claim 4, wherein said second section is coupled to said first section in such a manner that a majority of the first handle is exposed.

6. Packaging according to claim 5, wherein said first and second sections cover substantially all of a remainder of the controller.

7. Packaging according to claim 4, wherein said second section is coupled to said first section in such a manner that said first and second sections expose at least four buttons on the game console controller.

8. Packaging according to claim 1, wherein said second section is coupled to said first section in such a manner that said first and second sections expose at least four buttons on the game console controller.

9. Packaging according to claim 1, wherein said second section is coupled to said first section in such a manner that an opening is created therebetween, said opening adapted to allow a portion of the game console controller to extend therethrough.

10. A packaging system for a game controller, the game controller including a main portion, a first handle, and a second handle, the first handle having at least one control button thereon and at least one of the second handle and the main portion having at least one directional control device thereon, the packaging comprising:

a first portion having a cavity therein, said cavity adapted to receive the second handle and at least a portion of the main portion, including the at least one directional control device;

an opening in said cavity, said opening adapted to allow the first handle to extend therethrough and expose at least the at least one control button;

a first leg coupled to said first portion; and a second leg coupled to said first portion, said first leg, said second leg and said first portion forming a substantially C-shape;

wherein said first handle extends through said opening and away from said first portion; and at least one of said first and second legs extends away from said main portion and farther than the first handle.

11. Packaging according to claim 10, wherein both of said first and second legs extend away from said main portion and farther than the first handle.

* * * * *